United States Patent [19]

Hicks

[11] Patent Number: 4,723,612

[45] Date of Patent: Feb. 9, 1988

[54] BIT, NOZZLE, CUTTER COMBINATION

[76] Inventor: Dusty F. Hicks, P.O. Box 7707, Midland, Tex. 79705

[21] Appl. No.: 925,311

[22] Filed: Oct. 31, 1986

[51] Int. Cl.[4] ..... E21B 10/60

[52] U.S. Cl. ..... 175/393; 175/410; 175/418; 175/424

[58] Field of Search ..... 175/65, 329, 339, 340, 175/393, 410, 417, 418, 424; 299/81

[56] References Cited

U.S. PATENT DOCUMENTS

| | | | |
|---|---|---|---|
| 3,070,182 | 12/1962 | Runte | 175/339 |
| 3,753,597 | 8/1973 | French | 299/81 |
| 4,190,126 | 2/1980 | Kabashima | 175/410 |
| 4,239,087 | 12/1980 | Castel et al. | 175/340 |
| 4,285,409 | 8/1981 | Allen | 175/339 |
| 4,303,136 | 12/1981 | Ball | 175/329 |
| 4,334,585 | 6/1982 | Upton | 175/329 |
| 4,442,909 | 4/1984 | Radtke | 175/329 |
| 4,452,324 | 6/1984 | Jürgens | 175/393 |
| 4,460,053 | 7/1984 | Jürgens et al. | 175/329 |

*Primary Examiner*—James A. Leppink
*Assistant Examiner*—Terry Lee Melius
*Attorney, Agent, or Firm*—Marcus L. Bates

[57] ABSTRACT

A rotating diamond bit has a cutting face that includes a plurality of cutters and nozzles affixed thereto in spaced relationship respective to one another. A passageway extends through the bit body for flow of fluid through the bit connection to each of the nozzles. Each nozzle has an outlet orifice arranged to direct a lateral flow therefrom which impinges on the cutting face of each of the diamond compacts. The nozzles and compacts are arranged in groups, with there being a plurality of cutters and at least one nozzle in each group. The lateral flow from the nozzles diverges in a fan-like pattern to impinge directly onto the cutting face of each of the plurality of cutters.

1 Claim, 10 Drawing Figures

BIT, NOZZLE, CUTTER COMBINATION

BACKGROUND OF THE INVENTION

Polycrystalline diamond compact drill bits are sensitive to the hydraulic cooling and cleaning of the cutting face thereof. Drilling fluid is pumped down the drill string and is forcibly ejected through a plurality of nozzles to impact on the bottom of the hole. The high pressure hydraulic flow from the nozzles is the sole means of preventing the polycrystalline diamond cutters from overheating or balling up with formation cuttings.

In the prior art drill bits, the jets of drilling fluid emerging from the nozzles first impacts on the formation being penetrated by the bit. The impact of the jet is diverted by the bottom of the hole into a lateral flow respective to the borehole axis and more or less parallel to the formation surface. Hence, the jet splatters after leaving the high pressure bit nozzle, thereby producing strong flow in some directions and unsatisfactory flow in other directions. This disorderly impact of the jet of drilling fluid respective to the formation being penetrated represents an undesirable loss of hydraulic energy and results in inadequate cooling and cleaning of the cutters.

The useful life of a polycrystalline diamond cutter face or compact is greatly extended when it receives adequate lubrication and cooling from the drilling fluid. On the other hand, where the polycrystalline diamond cutter face receives inadequate fluid flow, the cutter face will ball up with the cuttings which pile up in front of the cutting surface and isolates the cutter surface from the drilling fluid. This action causes the rate of penetration of a polycrystalline diamond bit to be greatly decreased. If the ball-up condition is severe, the cutters will overheat and rapidly wear, and the bit will have to be replaced in short order.

Therefore, it would be desirable to prevent the clogging and inadequate cooling of the cutting face of a polycrystalline diamond cutter. This can be achieved by more precisely applying the available hydraulic fluid directly towards the cutting face of the cutters. A drill bit made in accordance with the present invention achieves this desirable goal.

SUMMARY OF THE INVENTION

This invention relates to drilling apparatus, and particularly to polycrystalline diamond drill bits. A rotating polycrystalline diamond bit has a main body, with there being a fluid conducting connection formed at the upper end of the main body; and a formation cutting face formed at the opposed lower end of the main body. The cutting face includes a plurality of polycrystalline diamond cutters affixed thereto in spaced relationship respective to one another. The cutting face also includes a plurality of nozzles affixed to the face in spaced relationship respective to one another and to the plurality of cutters.

Passageway means extend through the main body for flow of drilling fluid through the connection and to each of the nozzles. Each nozzle has means forming an outlet orifice arranged to direct a lateral flow therefrom, with each nozzle orifice being oriented to direct flow from the nozzle orifice directly onto at least one of the cutter faces.

The nozzles and cutters are arranged in groups, with there being at least one nozzle and a plurality of cutters in each group. Each group has the nozzle thereof oriented respective to the cutting face of the polycrystalline diamond cutters thereof such that each of the cutters of the group directly receives flow of drilling fluid from the nozzle orifice, with the flow from the orifice directly impinging upon the diamond cutting face of the cutters of the group.

The nozzles have an inlet end which is attached to the bit body, with the opposed outlet end terminating in close proximity to the face of the bit body. The polycrystalline diamond cutters have a marginal end affixed within the bit body, with the opposed cutter end extending further from the face of the bit body respective to the nozzles, so that the diamond cutting face of the cutters engage and remove part of a formation and supports the nozzles in a slightly spaced relationship respective to the bottom of the borehole.

In one form of the invention, the nozzle is provided with an axial passageway connected to a slot-type lateral orifice formed in the side of the nozzle body so that the angle of divergence of the drilling fluid leaving the nozzle orifice fans out sufficiently to impinge against the faces of a plurality of cutters.

Some material of the bit body between the cutters and the nozzle is removed to form a cavity which provides operating room for the high velocity jet of drilling fluid leaving the nozzle orifice.

Accordingly, a primary object of the present invention is the provision of a bit nozzle and cutter combination arranged in a manner whereby drilling fluid directly impinges on the cutting face of the cutters.

Another object of the invention is to provide a rotary bit having a nozzle that includes an orifice arranged for flow to occur longitudinally through part of the nozzle and then turn laterally through the orifice where the flow of high pressure drilling fluid directly impinges on the cutting face of a diamond cutter.

A further object of this invention is to disclose and provide a rotating diamond bit having groups of nozzles and cutters arranged on a cutting face thereof, with there being a plurality of cutters and at least one nozzle in each group, with the nozzle having an orifice formed in a sidewall thereof whereby flow occurs longitudinally through the nozzle and then is turned laterally at the orifice and directly impinges upon the cutting faces of the cutters of the group.

Another and still further object of this invention is the provision of method of drilling wherein there is a bit having a plurality of cutters affixed to the face thereof, and a plurality of nozzles arranged whereby each formation engaging face of the cutters receives drilling fluid from at least one nozzle, with there being a cavity formed in the bit face between the nozzle and the cutters to accommodate the high velocity flow of drilling fluid from the nozzle orifice to the face of the cutters.

An additional object of this invention is the provision of a drill bit having nozzles affixed to the face thereof, and wherein each nozzle has a plurality of orifices arranged therein to provide a divided lateral flow of drilling fluid to the face of a plurality of cutters.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described herein.

DETAILED DESCRIPTION OF THE PREFERRED EMBODIMENT

Figure 1:
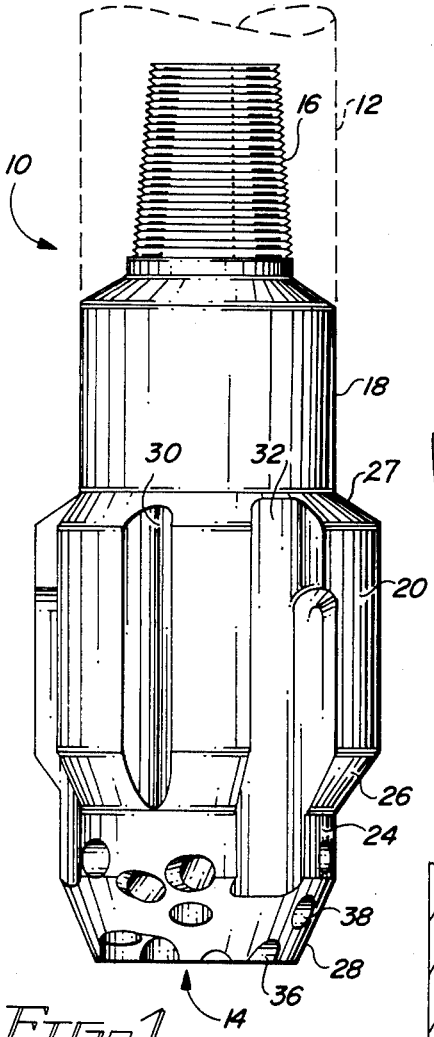
FIG. 1 (PRIOR ART)
FIG. 1 is a side elevational view of a rotating drill bit body of the prior art which has been modified for use in combination with the present invention.
Figure 2:
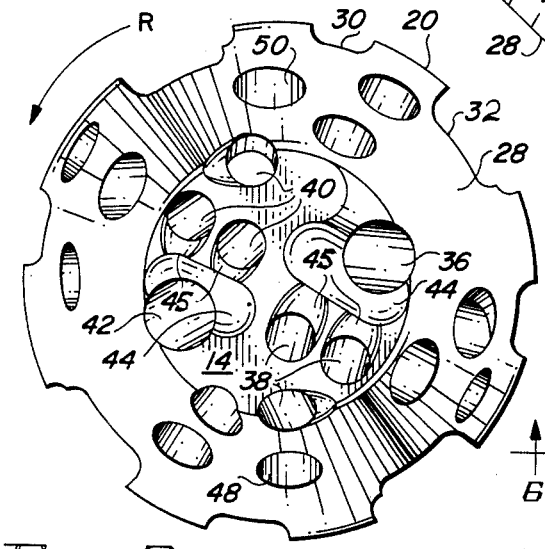
FIG. 2 (PRIOR ART)
FIG. 2 is a bottom view of the modified prior art bit disclosed in FIG. 1.
Figure 5:
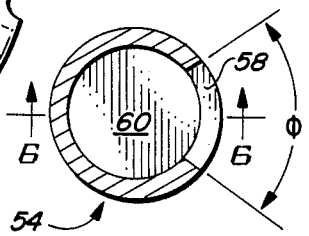
FIG. 5 is a lateral cross-sectional view taken along line 5—5 of FIG. 8.
Figure 6:
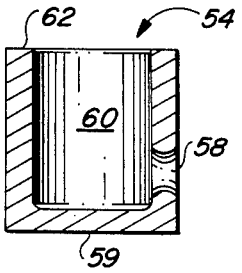
FIG. 6 is a longitudinal, cross-sectional view taken along line 6—6 of FIG. 5.

FIGS. 1 and 2 of the drawings disclose a modified prior art rotatable drill bit 10 for attachment to a drill string. The drill string is schematically indicated by numeral 12 in FIG. 1. The bit includes a lower face 14 and a fluid conveying threaded connection 16 at the opposed end thereof.

Numeral 18 indicates the shank of the bit which enlarges at 20. The enlargement 20 enables the provision of the illustrated inclines 26 and 27. The bit continues at 24 to form the formation engaging lower face 14 of the bit. The face 14 includes the conical shaped portion 28, which is a frustum of a cone.

A plurality of vertical milled slots form small flutes 30 and large flutes 32, which jointly cause enlargement 20 to take on the form of a plurality of radially spaced ribs.

Numeral 36 indicates a large bore for receiving a nozzle made in accordance with the present invention, as will be more fully explained later on. Numeral 38 indicates a group of small bores for receiving a mounting stud of a polycrystalline diamond cutter therein which are arranged according to the present invention.

Another group of small bores 40 receive another group of cutters therein, while enlarged bore 42 is arranged to receive a nozzle therein, in accordance with the present invention. Some of the intervening body of the bit face between bores 36, 38 and 40, 42 has been removed to form a cavity for accommodating a jet of drilling fluid which flows thereacross, as will be more fully disclosed later on herein.

Figure 3:
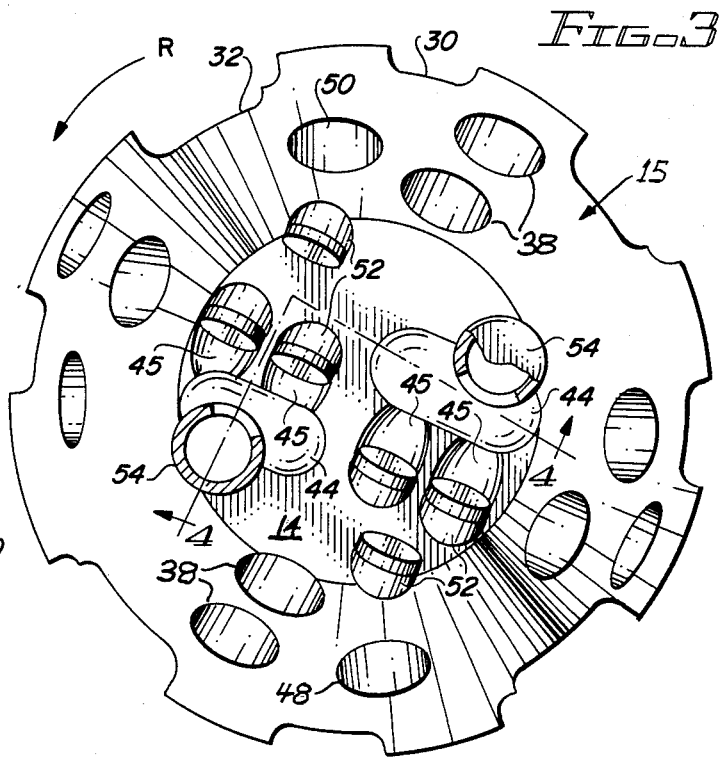
FIG. 3 is an enlarged bottom view similar to FIG. 2, with the present invention being shown in combination therewith.

In FIGS. 2 and 3, numerals 48 and 50, located in the inclined part 28 of face 14, indicated bores for receiving nozzles therein which are made in accordance with this invention. Numeral 52 indicates polycrystalline diamond cutters which are received within bores 38 and 40. The bores 36, 42, 48, and 50 are the same diameter and receive a nozzle therein. Bores 38 and 40 are the same diameter and receive the cutters therein.

Figure 4:
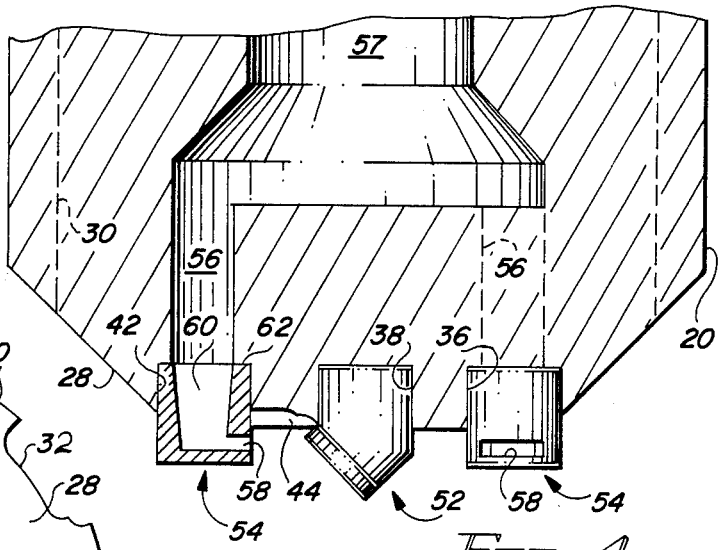
FIG. 4 is a part cross-sectional view taken along line 4—4 of FIG. 3.

The preferred embodiment of the invention is illustrated in FIGS. 3 and 4, wherein the polycrystalline diamond studs 52 have been mounted within bores 38 and 40 of FIG. 2 and are yet to be mounted in the small diameter bores of the conical face 28. Nozzles 54 have been mounted within the larger bores 36 and 42 and are yet to be mounted within bores 48 and 50.

As seen in FIG. 4, a passageway 56 communicates with axial passageway 57 which extends axially through the fluid conveying connection 16 and thereby provides each of the nozzles 54 with a source of drilling fluid.

As seen in FIGS. 3-6, each of the nozzles 54 have an outlet orifice 58 connected to receive flow of drilling fluid from an axial passageway 60. The nozzle terminates in a cylindrical shoulder 62. The upper marginal end of a nozzle 54 is received within one of the bores 36, 42, 48 or 50 formed within face 14 of the bit body.

Figure 7:
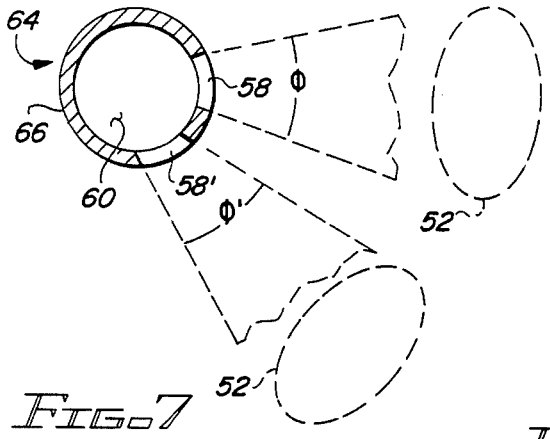
FIG. 7 is a lateral cross-sectional view which sets forth a modification of the structure disclosed in FIGS. 5 and 6.

FIG. 7 sets forth a nozzle 64 which is a modification of nozzle 54 seen in the foregoing figures. The nozzle 64 is provided with two circumferentially spaced outlet orifices 58, 58′ which are arranged within the cylindrical sidewall 66 thereof so that drilling fluid is forced to flow simultaneously along separate flow paths toward spaced cutters 52. The flow fans out as defined by the indicated angles $\phi$, $\phi'$.

Figure 8:
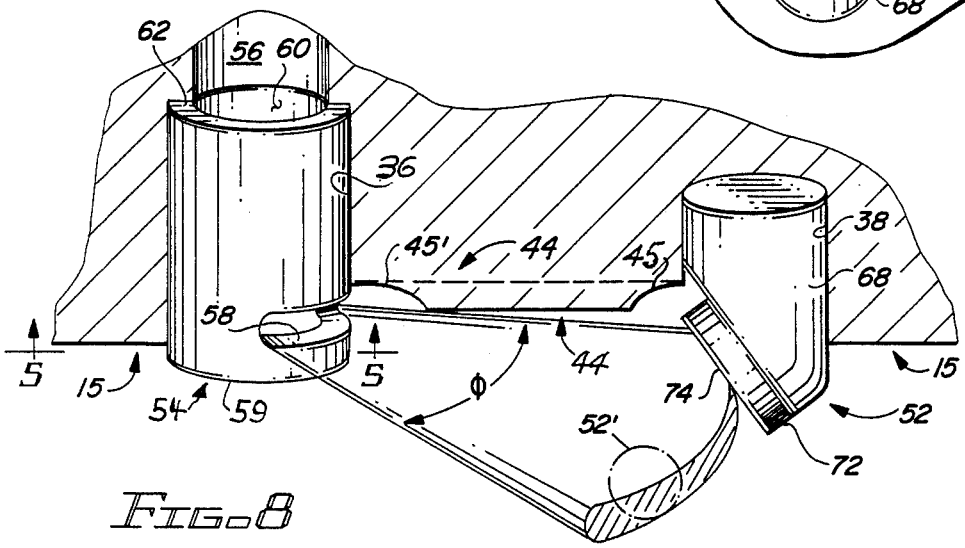
FIG. 8 is an isolated, detailed, part cross-sectional view of the apparatus disclosed in FIG. 4.
Figure 9:
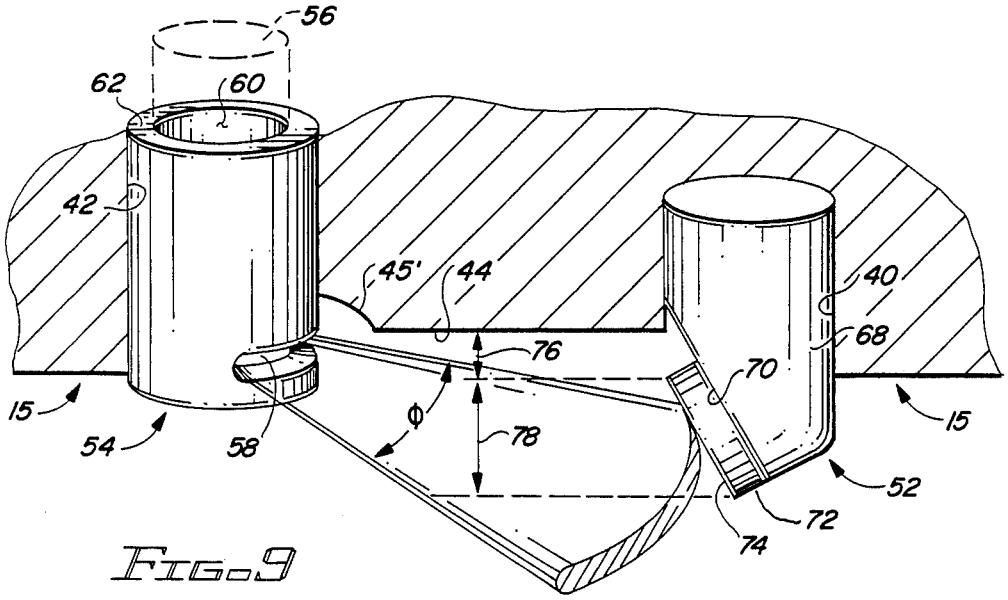
FIG. 9 sets forth a modification of the apparatus seen in FIG. 8.

FIGS. 8 and 9 show the details of the combination nozzle, cutters, bit, and cavity. As seen in FIG. 8, the bit face at 15 is provided with counterbores 38 and 36, respectively, for receiving the cutter stud and nozzle 68 and 54, respectively, in mounted relationship therein. The nozzle 54 has an axial passageway 60 which communicates with bit passageway 56 and orifice 58. Shoulder 62 of nozzle 54 is abuttingly received against the illustrated complementary shoulder formed between bore 36 and passageway 56.

In FIG. 8, the lower free terminal end 59 of nozzle 54 is spaced at a slightly lower elevation respective to surface 15 of face 14 of the bit body. Numerals 44 and 45 indicate the before mentioned cavity formed between the nozzle and stud. The dashed line near the arrow at numeral 44 indicates additional material that can be removed from the bit face, and thereby further enlarge the cavity 44 so that the cavity wall does not offer a barrier or restriction to the jet exiting orifice 58. Numeral 52′ indicates a second stud of a group of studs 52 positioned in the path of the jet $\phi$.

As seen in FIG. 9, the lower surface at 15 of the bit body 14 is removed as indicated by numeral 76 to provide a cavity or working chamber or adequate volume for accommodating the jet emitted from nozzle orifice 58. The cutter face 74 extends below lower face 15 of the bit body as indicated by numeral 78. Preferably, outlet orifice 58 of nozzle 54 is aligned with face 74 of cutter 52. The orifice 58 is of a suitable width, as illustrated in FIGS. 8-10, so that the jet of fluid is in the form of a fan which extends from sides 80-82 and thereby includes all of the cutters 52 of a group 84 within the path of the jet which flows from orifice 58.

Figure 10:
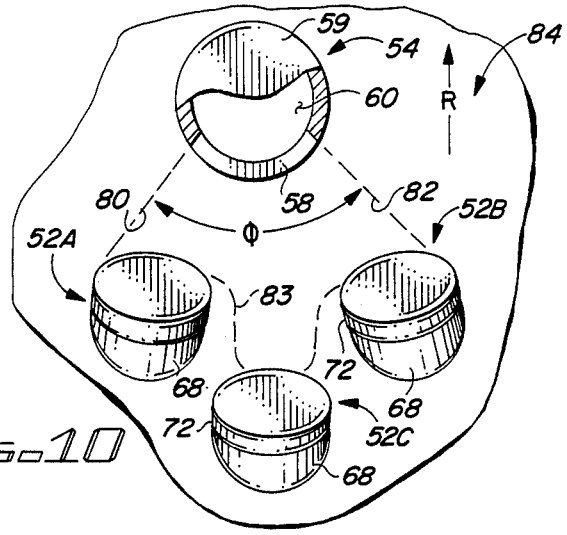
FIG. 10 is an isolated, bottom view of the apparatus seen in FIG. 9.

As illustrated in FIG. 10, a plurality of cutters 52A, 52B, and 52C and a nozzle 54 are arranged into a group 84. Hence, a group 84 includes one nozzle 54 and a plurality of cutters 52A, 52B, and 52C. The nozzle 54 and cutters 52 are spaced from one another, with nozzle 54 being oriented to direct a jet of drilling fluid from the orifice thereof, onto the face of each of cutters 52A, 52B, and 52C of group 84. The jet of drilling fluid has an angle of divergence defined by sides 80, 82. The angle is of a magnitude required to include all of the cutters 52A, 52B, and 52C therein.

In operation, the bit, nozzle, and cutter combination of the present invention is attached to a drill string 12 and lowered into a borehole and rotated in the direction indicated by the letter "R" in FIGS. 2 and 3. Drilling fluid flows down through drill string 12 and through connection 16, and to each of the nozzles 54 by means of axial bit passageway of FIG. 4, and to interconnecting passageways 56, nozzle passageway 60, and through the nozzle outlet orifice 58. The outlet orifice 58 is oriented respective to face 74 of the diamond disk 72 of the cutter 52, as illustrated.

I claim:

1. A rotatable bit having a main body, a fluid conducting connection formed at the upper end of said main body and a formation engaging surface formed at the opposed lower end of said main body;

said engaging surface includes a plurality of cutters removably affixed thereto in spaced relation respective to one another; said cutters include means forming a compact mounted on a stud and the stud is affixed to the bit so that the compact presents a cutting face to a formation being penetrated by the bit; a plurality of nozzles removably affixed to said engaging surface in spaced relation to one another and to said cutters; the bit body between said nozzles and the cutters associated therewith having a cavity formed therein to thereby provide an open area for accommodating fluid flow between said nozzles and said cutters;

passageway means extending through said main body for flow of fluid through said connection and to each of said nozzles;

each said nozzle having means forming an outlet orifice which is arranged to direct a flow of fluid from said nozzle onto at least one said cutter; said nozzle has a cylindrical body, an axial passageway formed in the nozzle body for conducting fluid flow to said orifice, said orifice is a slot arranged in a plane which is perpendicular to said axial passageway; said slot is formed through the sidewall of said cylindrical body and directs flow laterally respective to the nozzle passageway so that a fan of fluid is directed towards at least one of said plurality of cutters;

whereby, each cutter is provided with a direct lateral flow of fluid from one of said nozzles.

* * * * *